US008789704B2

(12) United States Patent
Nowak

(10) Patent No.: US 8,789,704 B2
(45) Date of Patent: Jul. 29, 2014

(54) SHIPPING AND DISPLAY CONTAINER

(75) Inventor: James Walter Nowak, Elk Grove Village, IL (US)

(73) Assignee: International Paper Co., Memphis, TN (US)

( * ) Notice: Subject to any disclaimer, the term of this patent is extended or adjusted under 35 U.S.C. 154(b) by 185 days.

(21) Appl. No.: 13/477,149

(22) Filed: May 22, 2012

(65) Prior Publication Data

US 2013/0313158 A1 Nov. 28, 2013

(51) Int. Cl.
*B65D 21/02* (2006.01)

(52) U.S. Cl.
USPC ..... 206/759; 206/736; 206/738; 229/122

(58) Field of Classification Search
CPC ..... B65D 21/02; B65D 5/54; B65D 5/72; B65D 5/38
USPC ..... 206/759, 736, 738, 774; 229/240, 123, 229/122
See application file for complete search history.

(56) References Cited

U.S. PATENT DOCUMENTS

| | | | | | |
|---|---|---|---|---|---|
| 2,556,707 | A * | 6/1951 | Rendall et al. | ..... | 229/121 |
| 2,684,792 | A * | 7/1954 | Kraus | ..... | 222/457 |
| 2,886,232 | A * | 5/1959 | Leone | ..... | 229/122.1 |
| 3,536,247 | A * | 10/1970 | Gadiel | ..... | 229/122.1 |
| 3,568,911 | A * | 3/1971 | Bebout | ..... | 206/738 |
| 3,944,128 | A * | 3/1976 | Hogan | ..... | 229/221 |
| 5,626,283 | A * | 5/1997 | Mellon | ..... | 229/120.13 |
| 6,189,778 | B1 * | 2/2001 | Kanter | ..... | 229/122.1 |
| 6,951,300 | B2 * | 10/2005 | Caille et al. | ..... | 229/121 |
| 8,141,713 | B2 * | 3/2012 | Farkas et al. | ..... | 206/762 |
| 2007/0051789 | A1 * | 3/2007 | Panduro et al. | ..... | 229/175 |

* cited by examiner

*Primary Examiner* — Steven A. Reynolds
(74) *Attorney, Agent, or Firm* — Matthew M. Eslami

(57) ABSTRACT

A shipping container convertible into a display container comprises a top wall, a bottom wall, and opposed side walls foldably joined to the top and bottom walls to form an interior space. A tear away window panel is formed on one of the side walls. The tear away window panel includes width and height defined by a perforated line of weakness extending across the width and on a portion of height of the side walls. A displayable insert tray is configured to be disposed into the interior space of the container to receive products and concealed therein when the container is in a shipping position. The displayable insert tray includes a bottom panel and at least one feeder ledge foldably joined to the bottom panel wherein upon removing the tear away window panel and pulling away the feeder ledge, the container is converted to a display position to expose the products.

11 Claims, 4 Drawing Sheets

SHIPPING AND DISPLAY CONTAINER

FIELD OF THE INVENTION

This invention relates to containers that are convertible from a shipping configuration to a display configuration. More particularly, the invention relates to a shipping and display container with a displayable insert tray that contains product during shipping and can be used at the point of sale for display and access to the product within the container.

BACKGROUND OF THE INVENTION

Many products for sale to the public are placed in a primary package that is designed for display at the point of sale. Common practice is to place a quantity of the primary packages in a secondary container for shipping. The retailer must then remove the primary packages from the secondary container and hang them from a hook or place them in another container or on a shelf for display. One common practice is to remove the primary packages from the shipping container and place them on a costly permanent plastic or metal display fixture with spring loaded attachments. This solution is labor intensive and costly to the retailer.

To solve this problem, packages have been designed that are used for both shipping the primary packages and then displaying them at the point of sale. These packages are especially convenient for the retailer, since it is not necessary for the retailer to remove the articles from a bulk shipping container to refill an existing display tray.

In attempting to adapt a conventional shipping container for display of the product items held therein, a retailer might use a cutting implement to cut away a section of the shipping container to form an opening for display of and access to the product items. However, the use of cutting implements to open cases can damage the products and can weaken the container to the point that it cannot be safely stacked with other containers.

In an effort to provide a container more suitable for displaying products in a retail setting, containers have been developed which are convertible to an open display configuration upon reaching the point of sale. Containers of this variety include those of a generally tray-like configuration with a removable cover. Although representing an improvement over conventional corrugated shipping containers, these containers still offer somewhat limited product access, particularly when such containers are in the midst of a stack of containers extending above and below.

Another important consideration with the design of a shipping container convertible to a display container is the compatibility of the container with existing automated manufacturing and packaging equipment. Containers are typically made on automated production lines. Any suitable container design should be compatible with such production equipment. Further, the packagers typically use automated packaging lines which assemble the container from a flat knocked down state and load the container with goods prior to the container being closed. Any design of a shipping container convertible to a display container should be compatible with automated packaging equipment.

A further important consideration is economy of manufacture. Regular slotted carton ("RSC") and half slotted carton ("HSC") boxes have been known in the art of shipping containers for many years. The RSC and HSC boxes are highly economical shipping containers due to the fact that there is very little manufacturing waste. Further, due to their rectangular shape they are well suited to shipping goods via cargo container, truck, train, or any other means of transport in which efficient use of space is a priority. As a result, RSC and HSC boxes are widely used for shipping and storing many different types of goods.

The RSC and HSC boxes are each formed from a single rectangular blank, typically of corrugated paperboard and have four rectangular sidewall panels. The RSC box has flaps on both the top and bottom edges of the sidewalls, and the HSC box has flaps only on the bottom edges of the sidewalls. The HSC box typically is used with a separate lid or cover, or is inserted into another box that forms a closure for the open top. In order to erect these boxes from a rectangular blank, four crush folds are made parallel to the depth of the box to define the four sidewall panels, and further crush folds are made parallel to the length and width of the box to define upper and lower flaps in the case of a RSC box, or to form lower flaps in the case of a HSC box. Either style of box is articulated by folding along the crush folds so that the sidewall panels are disposed at right angles to one another and the flap panels are folded inwardly to close the top and bottom of the box (RSC) or the bottom of the box (HSC), with the flaps associated with the shorter sides of the box being folded inwardly first, followed by the flaps associated with the longer sides. The flaps are then secured in closed position by any suitable means, such as tape, adhesive, staples, etc. The bottom side of either style box typically is closed first, the desired goods are then inserted into the box, and the top side is then closed. However, the box may instead be articulated around the goods themselves and the top and bottom closed thereafter.

One significant disadvantage of the RSC and HSC boxes, however, is the fact that such boxes are not well suited for use as display containers in a retail environment. This is due to the fact that the goods within opened RSC and HSC boxes are not visible, other than from the top, unless a portion of one or more sidewall panels is first separated from the box by means of cutting or tearing. Not only does this require additional effort on the part of the retailer, it also tends to result in an unattractive display container having rough, uneven edges, which can be unsightly in the retail environment.

As a result, goods shipped in an RSC or HSC box typically are removed from the box upon arrival at the vending location and placed on shelves or into other containers for display, with the box then simply being discarded. This results in both a significant expenditure of time on the part of the retailer in transferring the goods from the shipping boxes to the display environment, as well as added expense in the form of shelving or display bins for such goods.

Accordingly, there is need for a shipping and display container that can utilize a RSC box design for shipping and storage and enables the container to be easily converted to a display container at the point of sale without requiring the use of cutting implements to form an access to the products.

SUMMARY OF THE INVENTION

The shipping and display container of the invention combines the manufacturing, packing and shipping advantages of a simple regular slotted container (RSC) with a feature of a displayable insert tray. Typically, to use a regular slotted container as a displayable and dispensable, a tear-away window on the top-front of the RSC may be required. Generally, the retailer would tear the window off and the product could be displayed and accessed through the window. The more products that gets removed, the farther back the customer needs to reach into the display to get the product and this requires the retailer to pull the product forward for better presentation. The present invention solves this problem which allows a user to remove the window on the bottom of the RSC, pull out the feeder door of the displayable insert tray, and let the product in the displayable insert tray refill itself. Moreover, the construction of container can be run entirely on existing packaging machinery, or can be an assembly manually, depending on the customer's needs.

Other advantages of the invention are 1) eliminates the requirement for permanent store fixtures used to perform the function of holding primary packages upright, and reduces the re-stocking labor required by permanent displays, 2) permits a low-cost, source-reduced, recyclable package to be used in lieu of other costly and non-environmentally friendly options, 3) capable of being produced on automatic packaging machines for carton erection and filling, and placing the product into the secondary package, and 4) from a package production perspective, the invention can be applied using current existing die cutting and standard RSC-making operations such as those used in International Paper Company's facilities.

Accordingly, the present invention is directed to a shipping container convertible into a display container comprising a top wall, a bottom wall, and a plurality of opposed side walls foldably joined to the top and bottom walls to form an interior space. At least one tear away window panel is formed on one of the plurality of the side walls. The at least one tear away window panel having width and height defined by a perforated line of weakness extending across the width and on a portion of height of the side walls. A displayable insert tray configured to be snuggly disposed into the interior space of the container to receive products and concealed therein when the container is in a shipping position. The displayable insert tray includes a bottom panel and at least one feeder ledge foldably joined to the bottom panel wherein upon removing the tear away window panel and pulling away the feeder ledge, the container is converted to a display position to expose the products.

Another aspect of the present invention is directed a shipping container having a bottom wall, a top wall, and a plurality of opposed side walls foldably joined to one another to form an interior space. The shipping container convertible into a display container comprising a displayable insert tray having a bottom panel and at least one feeder ledge foldably joined to the bottom panel. The displayable insert tray is configured to be snuggly disposed into the interior space of the container to receive products and concealed therein when the container is in a shipping position. Upon removing a portion of one of the plurality of the side walls and pulling away the at least one feeder ledge, the container is converted to a display position to expose the products. The portion of one of the plurality of the side walls includes a tear away window panel being formed on one of the plurality of the side walls. The tear away window panel has width and height defined by a perforated line of weakness extending across the width and on a portion of height of the side walls. The least one feeder ledge has a pair of tucked-in flaps foldably joined on opposed lateral edges thereof which tucked-in into the interior space of the container in contiguous, parallel, overlapping relationship with adjacent side walls when the products is unexposed. The tucked-in flaps include a hook formed outwardly on respective free edges thereof. The hook engages with the respective side wall to hold the feeder ledge in the specific angle pulled away position to expose the products as well as prevent the product from spilling out of the display tray. The bottom panel of the displayable insert tray comprises at least one pair of slots spaced apart from one another and are formed on proximity of a fold line joining the bottom panel to the feeder ledge. At least one feeder ledge includes two locking tabs formed on free edge thereof and spaced apart from one another. Each of the locking tabs is inserted into the corresponding slot formed on the bottom panel.

A further aspect of the present invention is directed to a shipping container convertible into a display container at a point of sale. The shipping and display container comprising a top wall, a bottom wall, and a plurality of opposed side walls foldably joined to the top and bottom walls to form an interior space. Two tear away window panels each of which being formed on respective two of the plurality of the side walls. Each of the two tear away window panels has width and height defined by a perforated line of weakness extending across the width and on a portion of height of the respective two of the plurality of the side walls. A displayable insert tray is configured to be snuggly disposed into the interior space of the container to receive products and concealed therein when the container is in a shipping position. The displayable insert tray includes a bottom panel and two feeder ledges foldably joined to the opposed edges of the bottom panel wherein upon removing the respective two tear away window panels and pulling away the respective two feeder ledges, the container is converted to a display position to expose the products.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 2:
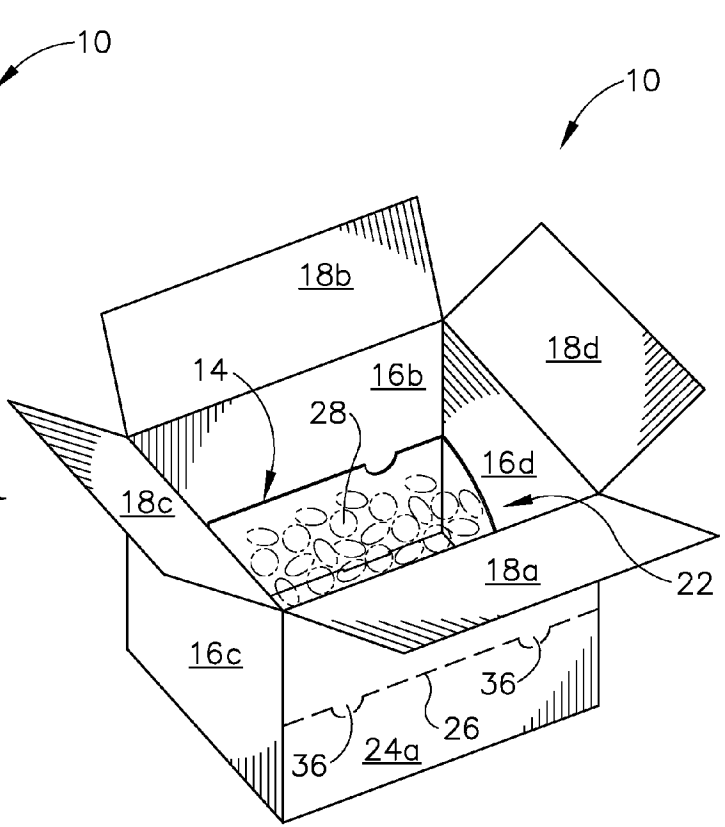
FIG. 2 is a top perspective view of the shipping and display container in an open position illustrating the displayable insert tray disposed into the shipping container and contains products therein in accordance to a preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. In addition, the phrase "feeder ledges" generally means that due to the structure of the displayable insert tray of the shipping and display container, it is resembled, but not limited, to a bird-feeder tray.

Figure 1:
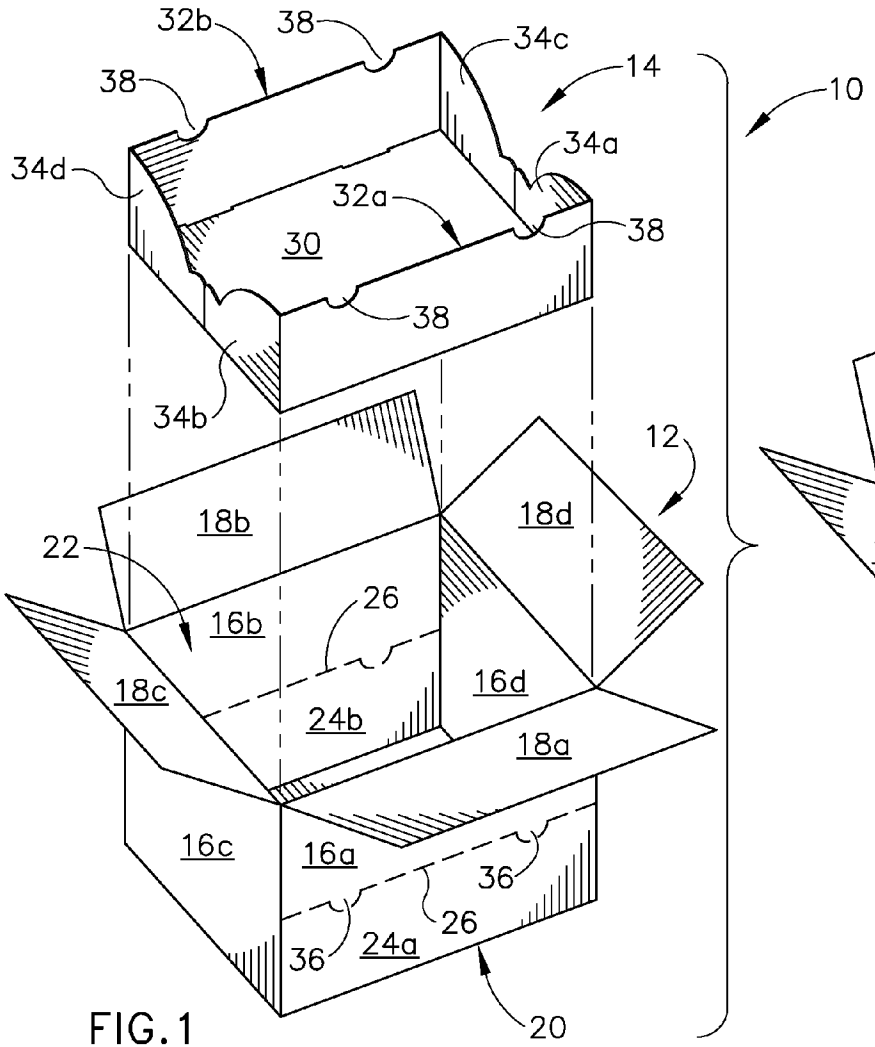
FIG. 1 is an exploded top perspective view of a shipping container having a displayable insert tray positioned in a spaced relationship thereof so that to be convertible to a display container in accordance to a preferred embodiment of the invention.
Figure 3:
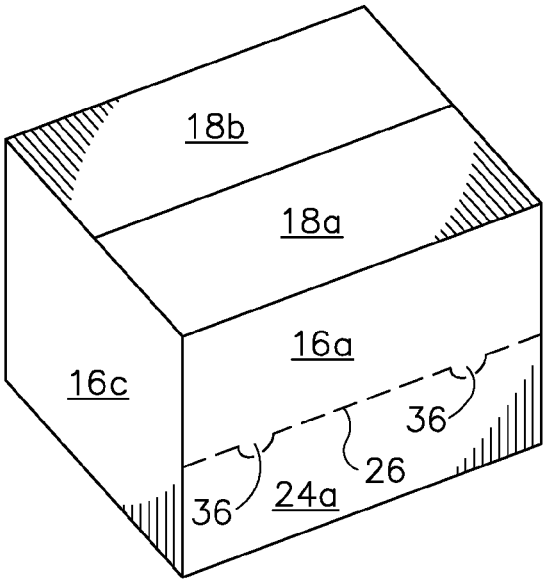
FIG. 3 is a top perspective view of the shipping and display container shown in FIG. 2.

A shipping and display container according to the invention is indicated generally at 10 in FIGS. 1 and 2 in its shipping configuration. The shipping and display container 10 comprises a shipping container 12 and a displayable insert tray 14 configured to be snuggly disposed therein. The shipping container 12 is in the style of a RSC box with opposed parallel sidewalls 16*a*, 16*b*, 16*c*, and 16*d*, major top flaps 18*a*, 18*b*, 18*c*, and 18*d* forming the top wall 18 and major bottom flaps 20*a*, 20*b*, 20*c*, and 20*d* forming the bottom wall. The top wall 18, the bottom wall 20, and the plurality of side walls 16 foldably joined to the top and bottom walls to form an interior space 22. At least one or preferably two tear away window panels 24*a*, 24*b* are formed on two of the opposed side walls 16*a*, 16*b*. One of ordinary skill in the art would appreciate that there may be only one tear away window panel 24*a*. Alternatively, the two tear away window panels 24*a*, 24*b* can be formed on opposed side walls 16*c*, 16*d*. The tear away window panel 24*a* having width and height defined by a perforated line of weakness 26 extending across the width and on a portion of height of the side walls 16*a*, 16*b*. The displayable insert tray 14 is configured to be snuggly disposed into the interior space 22 of the container 12 to receive products 28 and concealed therein when the container 10 is in a shipping position. The displayable insert tray 14 includes a bottom panel 30 and two feeder ledges 32*a*, 32*b* foldably joined to the respective opposed edges of bottom panel 30 in which upon removing the tear away window panel 24*a*, 24*b* and pulling away the feeder ledges 32*a*, 32*b*, the container is converted to a display position to expose the products 28. Each of the feeder ledges 32*a*, 32*b* having a pair of optional tucked-in flaps 34*a*, 34*b* foldably joined on opposed lateral edges thereof which tuck into the shipping container 12 in contiguous, parallel, overlapping relationship with adjacent side walls 16*c*, 16*d* when the products 28 are unexposed as depicted in FIG. 3.

Figure 4:
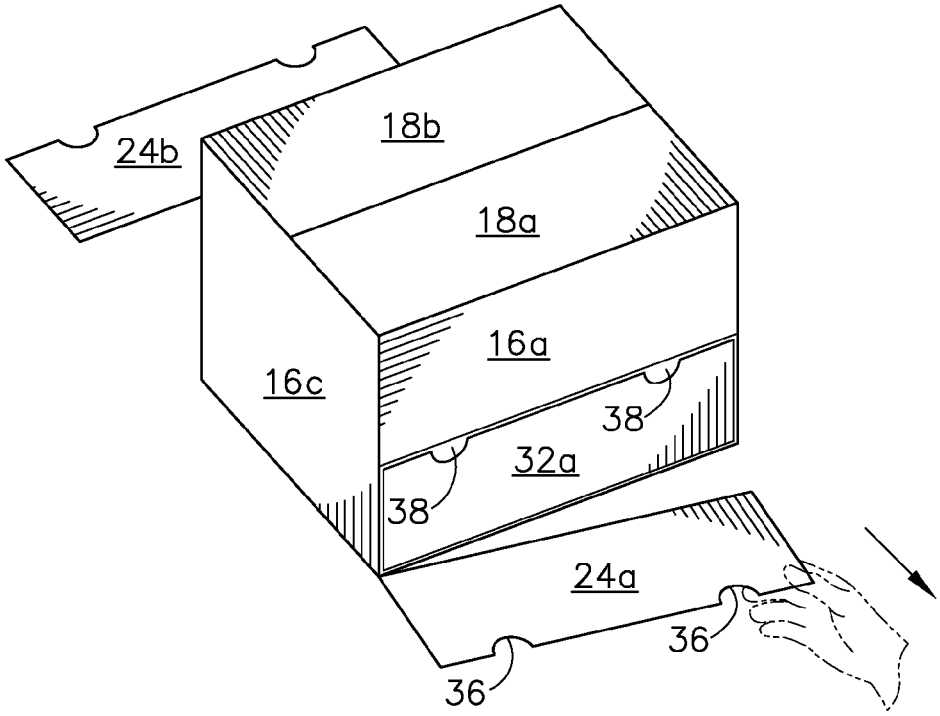
FIG. 4 is a front perspective view of the shipping and display container, depicting a user removing the tear away window panel.
Figure 5:
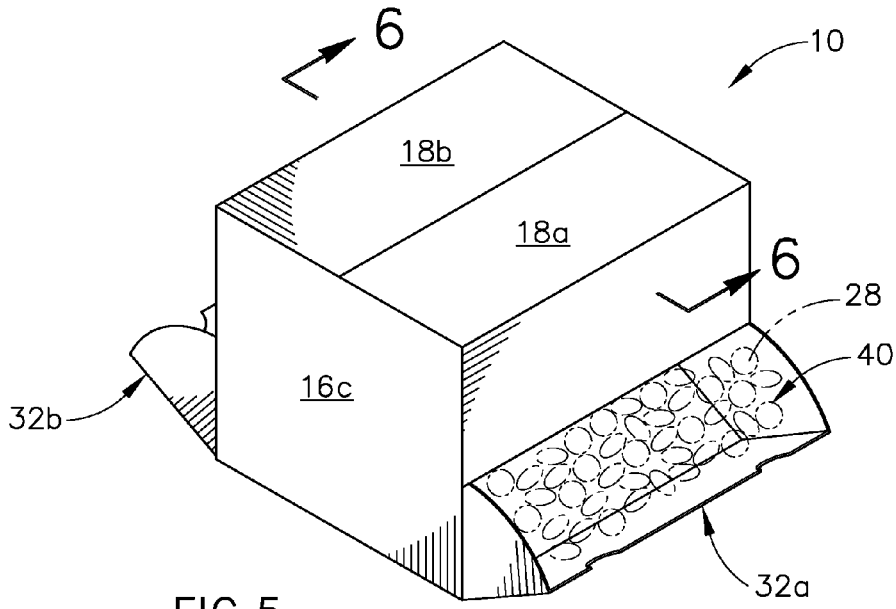
FIG. 5 is a front perspective view of the shipping and display container in its operative use position with the feeder ledges of displayable insert tray are pulled away to expose the products.

Referring to FIG. 4 is a front perspective view of the shipping and display container 10 depicting a user removing the tear away window panel 24*a* or 24*b*. The tear away window panel 24*a* is removed by pressing the punch-out tab 36 inwardly and inserting an index finger or fingers into the resultant opening 38 to separate the tear away window panel 24*a* or 24*b* from the respective side walls 16*a* or 16*b*. To expose the products, using the opening 38, the user pulls outwardly the feeder ledge 24*a* or 24*b* from the container, leaving a display opening 40 for display of the product and easy access to it as shown in FIG. 5. It should be noted that in the preferred embodiment of the invention there are two tear away window panels 24*a*, 24*b* that are formed on two of the opposed side walls 16*a*, 16*b*, however, one of ordinary skill in art would appreciate that there may be only one tear away window panels 24*a* that correspond to one feeder edge 32*a* without departing from the scope of the invention. Each of the two tear away window panels 24*a*, 24*b* has a width and a height which correspond to the width and height of the feeder ledges 32*a*, 32*b* so that the displayable insert tray 14 is concealed in the interior space 22 of the shipping and display container 10.

Figure 6:
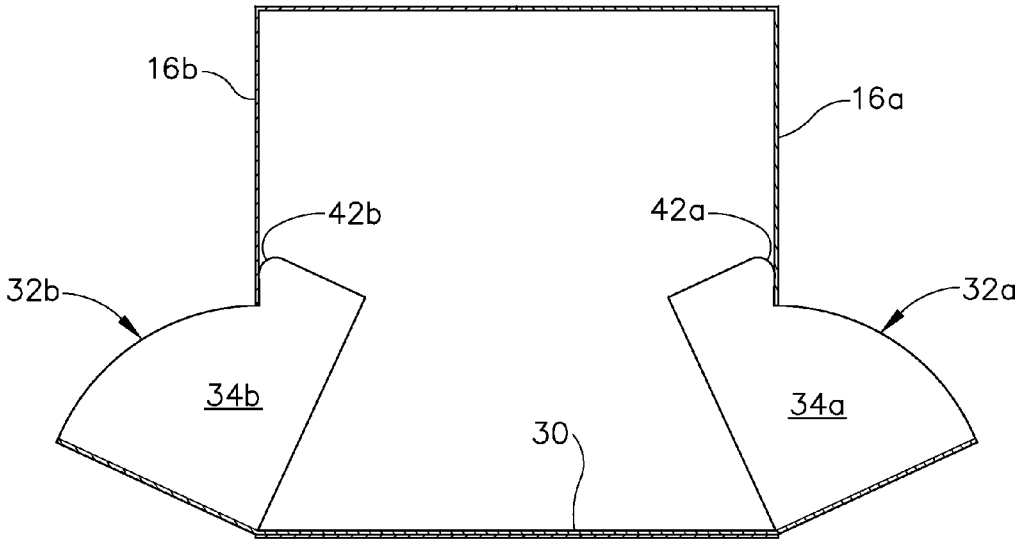
FIG. 6 is a cross sectional view of the shipping and display container of FIG. 5 taken along line 6-6.

FIG. 6 is a cross sectional view of the shipping and display container 10 of FIG. 5 taken along line 6-6. It is noted that the displayable insert tray 14 snuggly sits in the bottom of the shipping container 12 and is capable to be converted to a display container. The present invention solves one of the major drawbacks of the prior art display trays. For example, previously the retailer would tear the window off on a typical display box and the product could be displayed and accessed through the window. The more products that gets removed, the farther back the customer needs to reach deep into the display tray to get the product. This requires the retailer to pull the product forward for better presentation. The inventor has solved the aforementioned drawback by making the displayable insert tray 14 such that it the feeder ledges 32*a*, 32*b* are pulled away from the bottom panel 30 so that the gravity force pull the product down to the window/ ledge for display products 28 to be accessible as long as the container is full. As noted above, Each of the feeder ledges 32*a*, 32*b* having a pair of tucked-in flaps 34*a*, 34*b* foldably joined on opposed lateral edges thereof which tuck into the shipping container 12. Furthermore, each of the pair of the tucked-in flaps 34*a*, 34*b* includes a respective hook 42*a*, 42*b* formed outwardly on respective free edges of the respective tucked-in flaps 34*a*, 34*b* wherein the respective hook 42*a*, 42*b* engages with the respective edge side walls that was formed by the tear away window panel 24*a* to hold the respective feeder ledge 32*a*, 32*b* in the pulled away position to expose the products for easy access.

Figure 7:
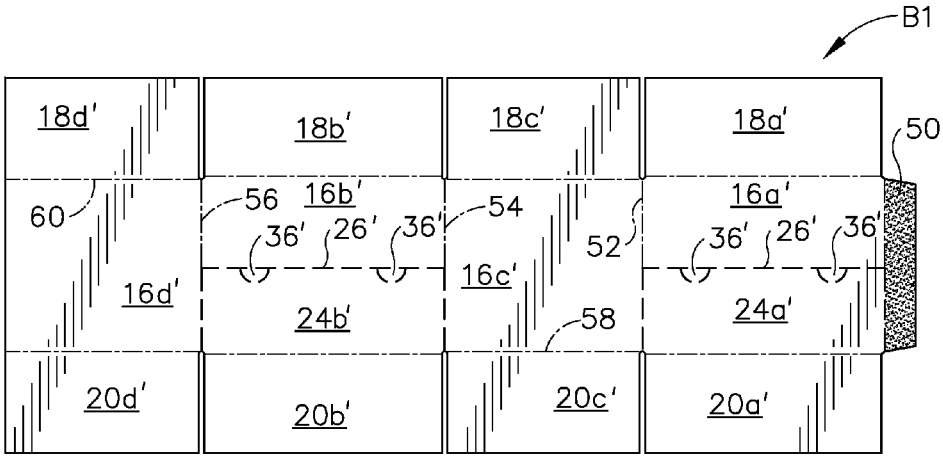
FIG. 7 is a top plan view of a one-piece blank for making the shipping container of the invention.

FIG. 7 is a top plan view of a one-piece blank B1 for making the shipping container 12 of FIG. 1. The blank B is substantially flat symmetrical with respect to its longitudinal axis thereof The blank B1 is preferably an integral piece of a material such as continuous sheet of conventional corrugated cardboard. The blank B1 is cut along its outer margins to form its specific shape. The blank B1 is divided into four sidewalls 16*a*', 16*b*', 16*c*', and 16*d*' by three parallel lateral fold lines 52, 54, and 56 and major top flaps 18*a*', 18*b*', 18*c*', and 18*d*' forming the top wall 18' by fold line 60 and major bottom flaps 20*a*, 20*b*, 20*c*, and 20*d* forming the bottom wall by fold line 58. To construct the blank B1, a glue flap 50 that is foldably extended from the side wall 16*a*' is used to enclose the side walls 16*a*', 16*b*', 16*c*', and 16*d*' to one another. Next, the bottom flaps 20*c*', 20*d*' are folded at right angle toward one another along the respective fold line 58 and 60, and similarly, the bottom flaps 20*a*', 20*b*' are folded at right angle toward one another along the respective fold line 58 and 60 to be overlapped onto the bottom flaps 20*c*', 20*d*'. Finally, the blank B1 is constructed to form the shipping container 12 as depicted in FIG. 1. Alternatively, one of ordinary skill in the art would appreciate that the shipping container may be any types of container such as, but not limited to, bliss style with built-in divider for receiving the displayable insert tray.

Figure 8:
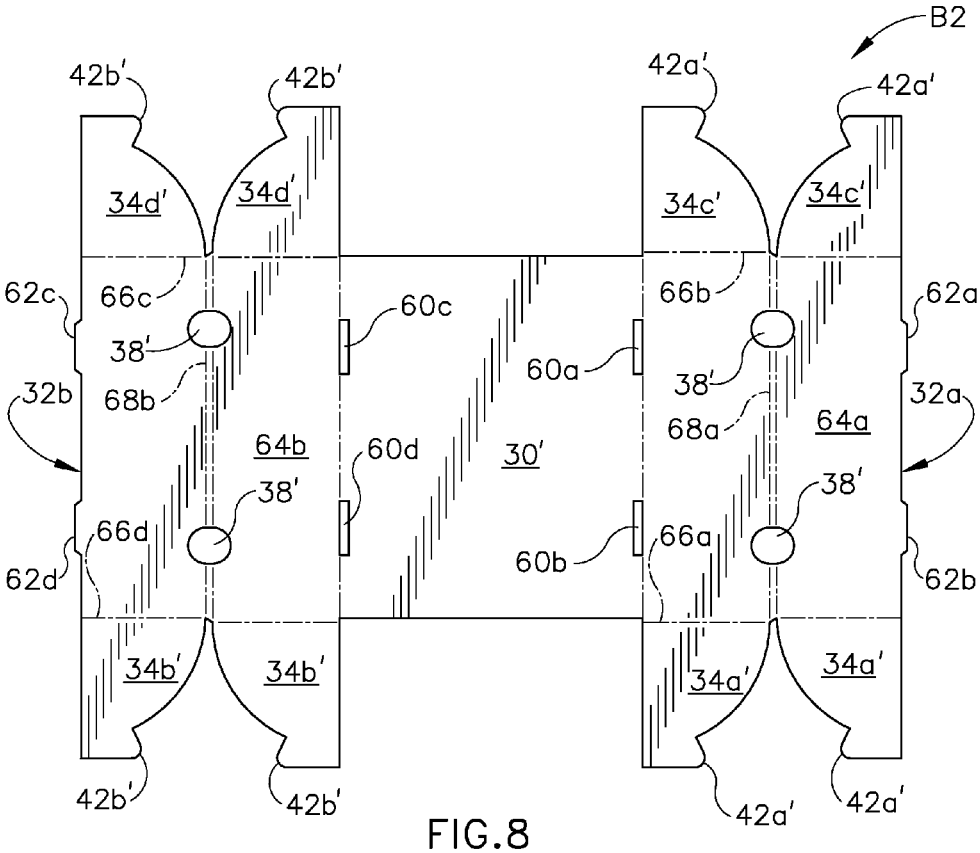
FIG. 8 is a top plan view of a blank for making the displayable insert tray of the invention.

FIG. 8 is a top plan view of a blank B2 for making the displayable insert tray 14 of the shipping and display container 10. The blank B2 is substantially flat symmetrical with respect to its lateral axis thereof The blank B2 is preferably an integral piece of a material such as continuous sheet of conventional corrugated cardboard. The blank B2 is cut along its outer margins to form its specific shape. The blank B2 is divided into a bottom panel 30' and two feeder ledge panels 32*a*' and 32*b*' by two parallel lateral fold lines 64, 66. The bottom panel 30 includes first pairs of slots 60*a*, 60*b* and second pair of slots 60*c*, 60*d* that are formed on longitudinal edge thereof in proximity of the respective fold lines 64 and 66. Each of the feeder ledge panels 32*a*' and 32*b*' includes a respective tray wall panels 64*a*, 64*b* define by respective fold lines 66*a*, 66*b*, 66*c*, and 66*d*. Each of the tray wall panels 64*a*, 64*b* includes two pair tucked-in flap panels 34*a*', 34*b*', 34*c*', 34*d*' that foldably extend from the lateral edge of the respective tray wall panels 64*a*, 64*b*. For example, the tucked-in flap panels 34*a*' is foldably extend from fold line 66*a*, the flap panels 34*b*' is foldably extend from fold line 66*d*, flap panels 34*c*' is foldably extend from fold line 66*b*, and the flap panels 34*d*' is foldably extend from fold line 66*c*. It should be noted that one of ordinary skill in the art would appreciate that the each tray wall panels 64*a*, 64*b* may include one pair tucked-in flap panels each of which foldably extend from the lateral edge of the respective tray wall panels 64*a*, 64*b*. Each of the tray wall panels 64*a*, 64*b* is foldaby divided longitudinally along respective fold lines 66*a*, 66*b* so that, in the folding position, each half is overlapped onto itself and are in registry with one another. Each of the tray wall panels 64*a*, 64*b* includes two recesses 38' formed on respective fold lines 68*a*, 68*b* and spaced apart from one another. Each of the tray wall panels 64*a*, 64*b* includes two locking tabs 62*a*, 62*b* and 62*c*, 62*d* that formed on respective free edges the and spaced apart from one another. When in folding position, the recesses 38'forms the openings 38 which permit a user to pull away the feeder ledge panels 32*a*' or 32*b*' to expose product for an easy access. The two locking tabs 62*a*, 62*b* and 62*c*, 62*d* each of which are inserted into the respective slots 60*a*, 60*b*, 60*c*, 60*d* when the blank B2 is in folding position.

The manual set-up of the blank B2 to form the displayable insert tray 14 is easily accomplished. However, one of ordinary skill in the art would appreciate that generally a folding machine alternatively performs the forming operations. The blank B2 is laid horizontally so that each of the tray wall panels 64*a*, 64*b* is first folded onto itself along respective fold lines 68*a*, 68*b* and then folded again upright along respective fold lines 64 and 66 so that the respective locking tabs 62*a*, 62*b*, 62*c*, 62*d* are inserted into the respective slots 60*a*, 60*b*, 60*c*, and 60*d*. Next, the respective tucked-in flap panels 34*a*', 34*c*' are folded at right angle toward the bottom panel 30' along fold lines 66*a* and 66*b* and simultaneously tucked-in flap panels 34*b*', 34*d*' are folded at right angle toward the bottom panel 30' along fold lines 66*c* and 66*d*. Finally, the displayable insert tray 14 is press fit into the interior space 22 of the shipping container.

In use, after the displayable insert tray 14 is press into the interior space 22, the product such as candy and the like are disposed into the displayable insert tray 14. Then the major top flaps 18*a*, 18*b*, 18*c*, and 18*d* forming the top wall 18 are brought into an overlapping relationship to enclose the shipping container 12. The shipping container 12 is transported into a retail store and the retailer removes the tear away window panel 24*a* or 24*b* by pressing the punch-out tab 36 inwardly and inserting the index finger or fingers into the resultant opening 38 to separate the tear away window panel 24*a* or 24*b* from the respective side walls 16*a* or 16*b*. To expose the products, using the opening 38, the retailer pulls outwardly the feeder ledge 24*a* or 24*b* from the container, leaving a display opening 40 for display of the product and easy access to it as shown in FIG. 5. It should be noted that multiple of these shipping and display container 10 can be stacked on one another and wrapped in a tube or sleeve to be a floor display or palletized and sold in bulk stores.

What is claimed is:

1. A shipping container convertible into a display container at a point of sale, comprising:

a top wall, a bottom wall, and a plurality of opposed side walls foldably joined to the top and bottom walls to form an interior space, at least one tear away window panel being formed on one of the plurality of the side walls, the at least one tear away window panel having width and height defined by a perforated line of weakness extending across the width and on a portion of height of the side walls; and a displayable insert tray configured to be snuggly disposed into the interior space of the container to receive products and concealed therein when the container is in a shipping position, the displayable insert tray includes a bottom panel and at least one feeder ledge foldably joined to the bottom panel wherein the at least one feeder ledge includes two locking tabs formed on a free edge thereof and spaced apart from one another, the bottom panel of the displayable insert tray is flat and coplanar with the bottom wall of the container wherein the bottom panel of the displayable insert tray comprises two pair of slots that each pair of slots is spaced apart from one another and is formed in proximity of a fold line joining the bottom panel to the at least feeder ledge wherein each of the locking tabs is inserted into each of the pair of slots formed on the bottom panel and wherein upon removing the tear away window panel and pulling away the feeder ledge, the container is converted to a display position to expose the products.

2. The shipping container convertible into a display container of claim 1 wherein the at least one tear away window panel includes two tear away window panels each of which is formed on one of two opposed side walls.

3. The shipping container convertible into a display container of claim 1 wherein the at least one feeder ledge of the displayable insert tray includes two feeder ledges each which is foldably joined to opposed edges of the bottom panel.

4. The shipping container convertible into a display container of claim 1 wherein the at least one feeder ledge having a pair of tucked-in flaps foldably joined on opposed lateral edges thereof which tucked-in into the interior space of the container in contiguous, parallel, overlapping relationship with adjacent side walls when the products is unexposed.

5. The shipping container convertible into a display container of claim 4 wherein each of the pair of the tucked-in flaps includes a hook formed outwardly on respective free edges thereof wherein the hook engages with the respective side wall to hold the feeder ledge in the pulled away position to expose the products.

6. A shipping container having a bottom wall, a top wall, and a plurality of opposed side walls foldably joined to one another to form an interior space, the shipping container convertible into a display container comprising:

a displayable insert tray having a bottom panel and at least one feeder ledge foldably joined to the bottom panel, at least one feeder ledge includes two locking tabs formed on a free edge thereof and spaced apart from one another, the bottom panel of the displayable insert tray comprises two pair of slots spaced apart from one another and are formed in proximity of a fold line joining the bottom panel to the at least one feeder ledge where each of the two locking tabs is inserted into each pair of the slots formed on the bottom wall, the bottom panel of the displayable insert tray is flat and coplanar with the bottom wall of the container, the displayable insert tray configured to be snuggly disposed into the interior space of the container to receive products and concealed therein when the container is in a shipping position wherein upon removing a portion of one of the plurality of the side walls and pulling away the at least one feeder ledge, the container is converted to a display position to expose the products.

7. The shipping container of claim 6 wherein the portion of one of the plurality of the side walls includes a tear away window panel being formed on one of the plurality of the side walls.

8. The shipping container of claim 7 wherein the tear away window panel having width and height defined by a perforated line of weakness extending across the width and on a portion of height of the side walls.

9. The shipping container of claim 6 wherein the least one feeder ledge having a pair of tucked-in flaps foldably joined on opposed lateral edges thereof which tucked-in into the interior space of the container in contiguous, parallel, overlapping relationship with adjacent side walls when the products is unexposed.

10. The shipping container of claim 9 wherein each of the pair of the tucked-in flaps includes a hook formed outwardly on respective free edges thereof wherein the hook engages with the respective side wall to hold the feeder ledge in the pulled away position to expose the products.

11. A shipping container convertible into a display container at a point of sale, comprising:

a top wall, a bottom wall, and a plurality of opposed side walls foldably joined to the top and bottom walls to form an interior space, two tear away window panels each of which being formed on respective two of the plurality of the side walls, each of the two tear away window panels having width and height defined by a perforated line of weakness extending across the width and on a portion of height of the respective two of the plurality of the side walls; and a displayable insert tray configured to be snuggly disposed into the interior space of the container to receive products and concealed therein when the container is in a shipping position, the displayable insert tray includes a bottom panel and two feeder ledges foldably joined to the opposed edges of the bottom panel, the bottom panel of the displayable insert tray is flat and coplanar with the bottom wall of the container, each of two feeder ledges includes two locking tabs formed on their respective free edge thereof, the bottom panel comprises two pair of slots that each of the pair of slots are spaced apart from one another and are formed in proximity of a fold line joining the bottom panel to the respective feeder ledges, each of the locking tabs being inserted into each of the slots formed on the bottom panel wherein upon removing the respective two tear away window panels and pulling away the respective two feeder ledges, the container is converted to a display position to expose the products.

* * * * *